US007735784B2

(12) United States Patent
Schalk

(10) Patent No.: US 7,735,784 B2
(45) Date of Patent: Jun. 15, 2010

(54) RAILROAD SWITCH INDICATOR

(76) Inventor: David A. Schalk, 2500 Rock-N-Horse Dr., Festus, MO (US) 63028

( * ) Notice: Subject to any disclaimer, the term of this patent is extended or adjusted under 35 U.S.C. 154(b) by 553 days.

(21) Appl. No.: 11/760,374

(22) Filed: Jun. 8, 2007

(65) Prior Publication Data

US 2008/0302921 A1 Dec. 11, 2008

(51) Int. Cl.
*B61L 5/12* (2006.01)

(52) U.S. Cl. ..... 246/476

(58) Field of Classification Search ..... 246/476, 246/473 R, 473.3, 474, 475; 116/2, 4, 12, 116/20, 28 R, 30, 35 R, 45, 50, 63 R; 40/375, 40/368, 370, 489–491

See application file for complete search history.

(56) References Cited

U.S. PATENT DOCUMENTS

| | | | | |
|---|---|---|---|---|
| 366,277 | A | | 7/1887 | Thomas et al. |
| 612,973 | A | | 10/1898 | Lewis |
| 824,270 | A | | 6/1906 | Zorge |
| 1,056,706 | A | | 3/1913 | Melick |
| 1,885,460 | A | | 11/1932 | McElhaney |
| 2,278,213 | A | | 3/1942 | Quenon |
| 2,740,041 | A | | 3/1956 | Marcum |
| 3,544,960 | A | * | 12/1970 | Hayes ..... 246/473 R |
| 4,837,957 | A | * | 6/1989 | Egender ..... 40/488 |
| 5,117,765 | A | * | 6/1992 | Wahl ..... 116/63 P |
| 5,192,038 | A | | 3/1993 | Ocampo |
| 5,791,605 | A | * | 8/1998 | Howie, II ..... 246/474 |
| 5,806,809 | A | | 9/1998 | Danner |
| 6,427,949 | B1 | | 8/2002 | Hager et al. |

* cited by examiner

*Primary Examiner*—S. Joseph Morano
*Assistant Examiner*—Robert J McCarry, Jr.
(74) *Attorney, Agent, or Firm*—Grace J. Fishel

(57) ABSTRACT

A railroad switch indicator for visually signaling the position of a pair of railroad switchpoints independently of the mechanism for operating the switch. The indicator includes a sleeve with windows in which is reciprocated a slide with reflectors selected ones of which are visible through the windows of the sleeve for indicating safety conditions of the track. An arm with an upwardly extending finger engages the slide and is attached to the transverse bar that moves the switchpoints for reciprocation of the slide within the sleeve conjointly with movement of the switchpoints by the transverse bar.

15 Claims, 5 Drawing Sheets

RAILROAD SWITCH INDICATOR

BACKGROUND OF THE INVENTION

1. Field of the Invention

The present invention relates to a railroad switch indicator positioned between the stockrails for visually signaling the position of a pair of railroad switchpoints independently of the mechanism for operating the switch.

2. Brief Description of the Prior Art

In order to optionally switch a railroad train operating on one track to a second track, it is typical to provide a switch with a pair of switchpoints which are selectively movable horizontally to deflect the train toward one or the other of the tracks. The switchpoints may be driven by a manual or electrical powered mechanism. A signal is usually associated with the mechanism for operating the switch to visually indicate how the switch is lined. If a train runs through the switch or if the switchpoints are moved by vibrations of a train rolling over the track, the switchpoints may be moved into a mid position which is not reflected by the signal associated with the mechanism for operating the switch. Sometimes even a misalignment of merely about 0.05 inch may result in a derailment which may be disastrous. Even sophisticated electrically powered switch mechanisms with sensors for open and closed switchpoints may give false signals.

In view of the above, it would be desirable to have a backup railroad switch indicator for signaling the position of the switchpoints that is mechanically linked to the switchpoints and operates independently of the mechanism for operating the switch.

BRIEF SUMMARY OF THE INVENTION

In view of the above, it is an object of the present invention to provide a railroad switch indicator that operates independently of the mechanism for operating the switch. It is another object to provide a railroad switch indicator that signals switch alignment and whether the switch has been run through. It is also an object to provide a railroad switch indicator that does not depend on electricity and can be used with mechanically operated switches as well as electrically powered switches. Other objects and features of the invention will be in part apparent and in part pointed out hereinafter.

In accordance with the invention, a railroad switch indicator is provided for use in visually signaling the position of a pair of railroad switchpoints. The railroad switch indicator does not require electricity and operates independently of and can be used with switches that are mechanically or electrically operated. The indicator includes a sleeve with windows in which is reciprocated a slide with reflectors selected ones of which are visible through the windows of the sleeve for indicating safety conditions of the track. The sleeve is mounted on a bracket attached to the track bed between the pair of switchpoints. An arm with an upwardly extending finger engages the slide and is attached to a transverse bar that moves the switchpoints. The finger is mounted through the arm to a bracket attached to the transverse bar and reciprocates the slide within the sleeve conjointly with movement of the switchpoints by the transverse bar.

The invention summarized above comprises the constructions hereinafter described, the scope of the invention being indicated by the subjoined claims.

BRIEF DESCRIPTION OF THE SEVERAL VIEWS OF THE DRAWING

In the accompanying drawings, in which several of various possible embodiments of the invention are illustrated, corresponding reference characters refer to corresponding parts throughout the several views of the drawings in which.

DETAILED DESCRIPTION OF THE INVENTION

Figure 1:
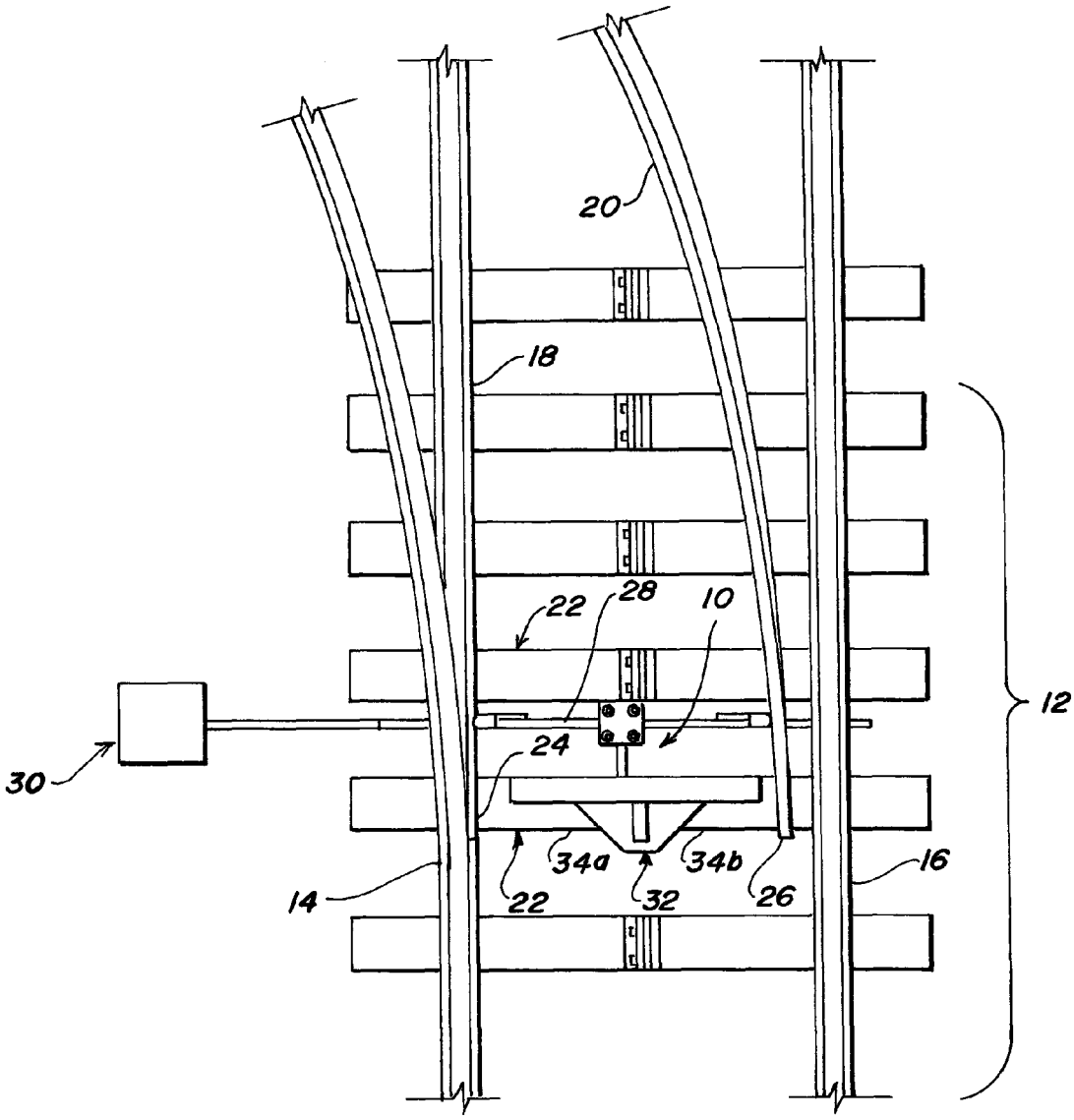
FIG. 1 is a plan view of a railroad switch provided with a railroad switch indicator in accordance with the present invention.

Referring to the drawings more particularly by reference character and beginning with FIG. 1, reference numeral 10 refers to a railroad switch indicator for use with a railroad switch 12 for switching a railroad train from one track to another. Railroad switch 12 normally comprises a pair of fixed outer stockrails 14, 16 and a pair of inner switchrails 18, 20. Stockrails 14, 16 are anchored to a plurality of cross ties 22 in track bed. Inner switchrails 18, 20 have one end rigidly secured to the track bed and the opposite end terminating in laterally spaced switchpoints 24, 26 arranged for conjoint lateral movement between laterally spaced switching and nonswitching positions. A transverse bar 28 connects inner rails 18, 20 for moving switchpoints 24, 26 conjointly from one position to another. Transverse bar 28 may be manually operated or electrically powered by a conventional mechanism 30.

As shown in FIG. 1, switchpoints 24, 26 are in nonswitching position with switchpoint 24 positioned against stationary left stockrail 14 and switchpoint 26 moved away from stationary right stockrail 16. In nonswitching position, switchpoint 24 will direct a train entering switch 12 straight through the intersection via right stockrail 16 and switchrail 18 which tapers outward into a straight left rail past switch 12. In a reverse position (not shown), both switchpoints 24, 26 are moved to the right with switchpoint 24 thus moved away from left stockrail 14 and switchpoint 26 moved to a position against right stockrail 16. Switchpoint 26 is thus in a position to direct the train to the left via left stockrail 14 which curves to the left past switch 12, and via right switchrail 20 which tapers outward to a curved right track past switch 12.

With continuing reference to FIG. 1, switch 12 is lined against a train curving to the left. If a train runs through switch 12 from the curved section, switchpoints 24, 26 will be pushed into a mid position such that they contact neither left or right stockrails 14, 16 and a train coming through switch 12 from bottom to top may derail if the operator depends on the signals associated with mechanism 30 for moving switchpoints 24, 26 if they falsely indicate that switch 12 remains lined for straight through travel.

Figure 2A:
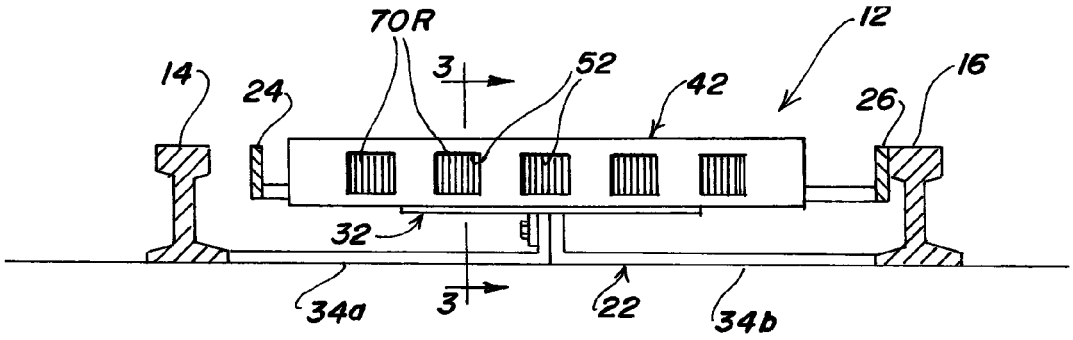
FIG. 2A is a side elevation of the railroad switch indicator signaling that a right switchpoint is in contact with a right stockrail.
Figure 2B:
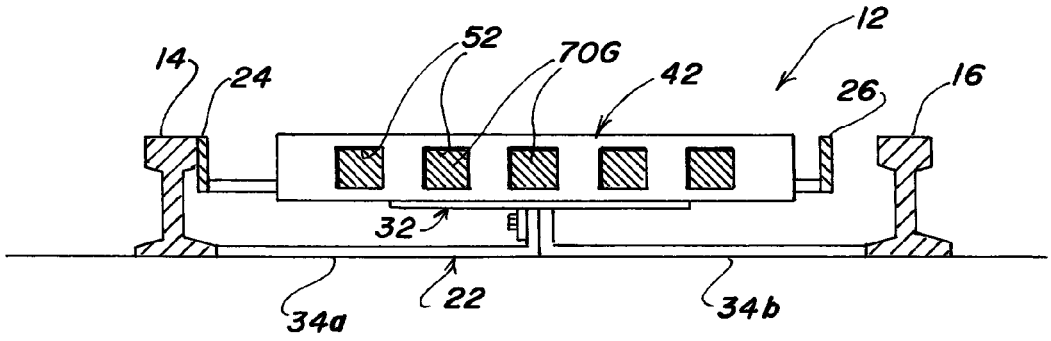
FIG. 2B is a side elevation of the railroad switch indicator signaling that a left switchpoint is in contact with a left stockrail.
Figure 2C:
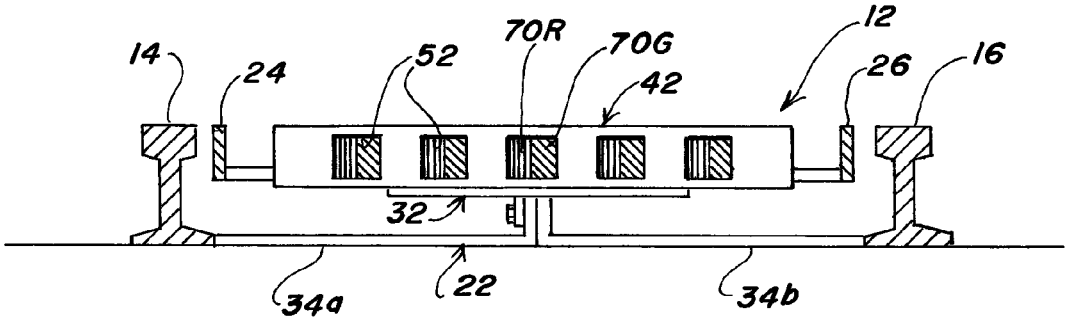
FIG. 2C is a side elevation of the railroad switch indicator signaling danger that the switchpoints are in a mid position.
Figure 3:
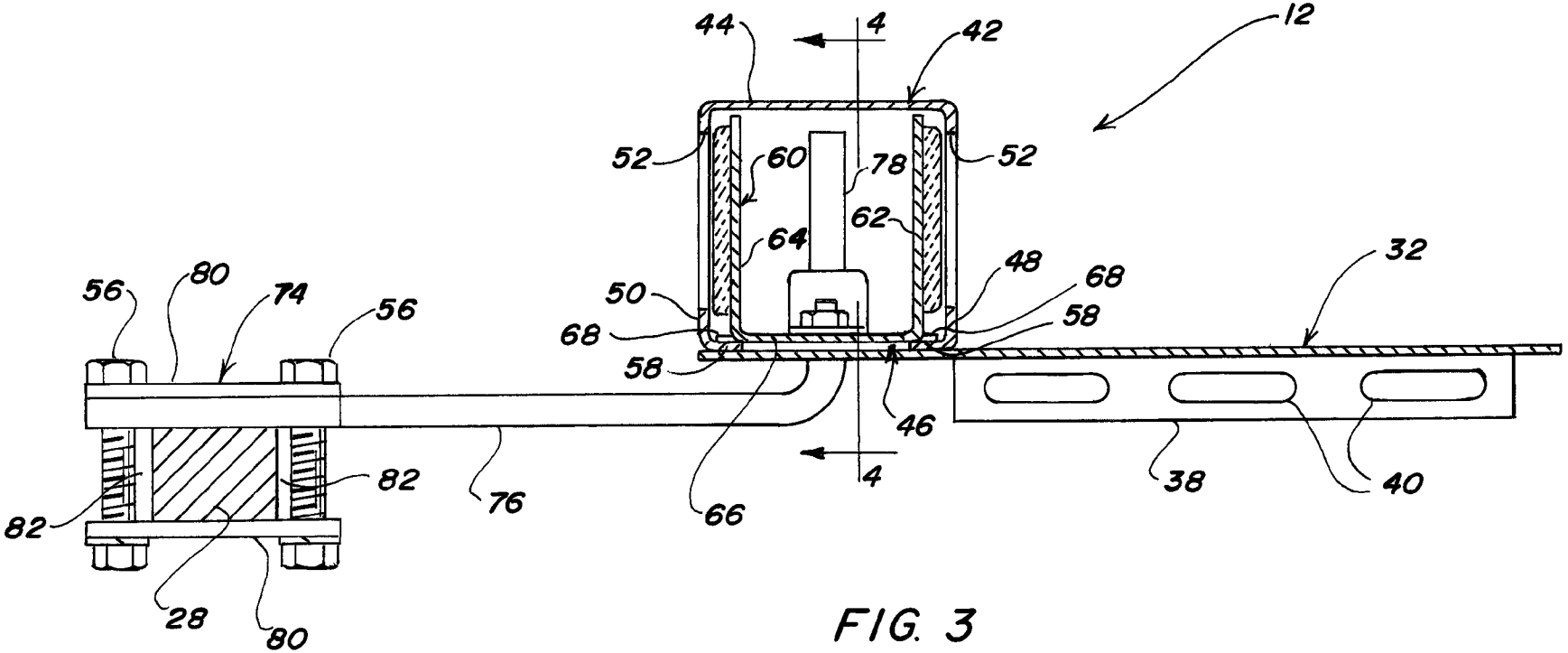
FIG. 3 is a slide elevation, partly in section, of the railroad switch indicator.
Figure 5:
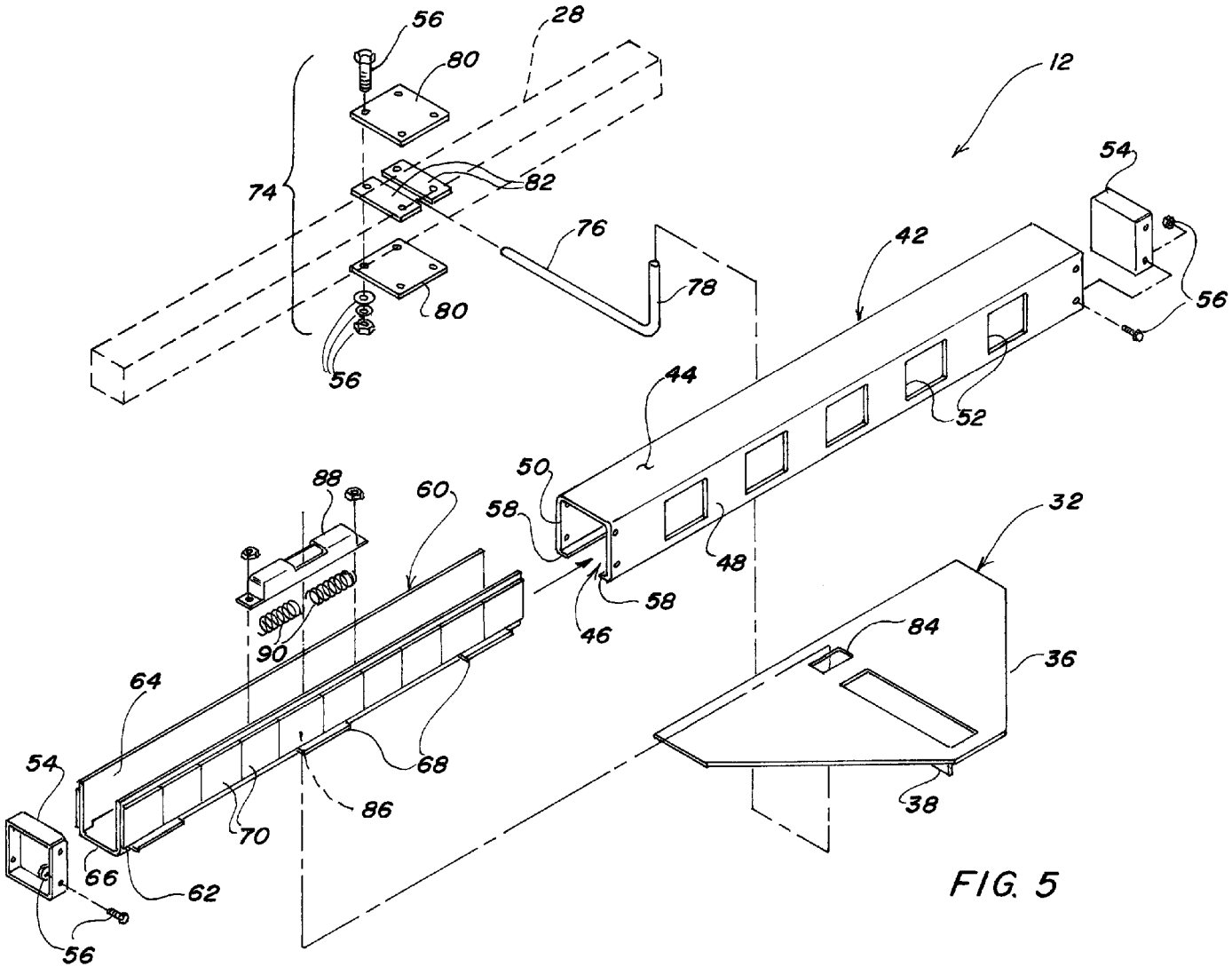
FIG. 5 is an exploded perspective view of the railroad switch indicator; and, FIG. 6 is a perspective view of a second slide.

As shown in FIGS. 1 and 5, railroad switch indicator 10 operates independently of mechanism 30 and includes a first bracket 32 which is adapted to be attached to one of cross ties 22 near switchpoints 24, 26. For example, when cross tie 22 is formed of metal as shown in FIGS. 2A-2C, it may include two flanged sections 34*a*, 34*b* separated with insulation such that the metal cross tie does not interfere with electrical signals passed down the track. As shown in FIG. 5, bracket 32 includes a triangular shaped plate 36 which is cantilevered to flanged sections 34*a*, 34*b* of metal cross tie 22 by an apron 38 which may be formed as an integral part of plate 36. As shown in FIG. 3, a series of holes 40 may be provided in apron 38 for bolting bracket 32 to flanged sections 34*a*, 34*b*.

An elongated, rectangular sleeve 42 is fixedly mounted on bracket 32 (e.g., with suitable fasteners or by welding). As best seen in FIGS. 3 and 5, sleeve 42 has a top wall 44, open bottom 46 and front and rear walls 48, 50, respectively, and is mounted between and transverse to stockrails 14, 16 (FIG. 1). A plurality of regularly formed, spaced apart windows 52 are formed in front and rear walls 48, 50. End caps 54 may be attached to sleeve 42 with suitable fasteners 56. The lower ends of front and rear walls 48, 50 may be provided with inwardly directed toes 58 which form a slideway for a slide 60.

Figure 6:
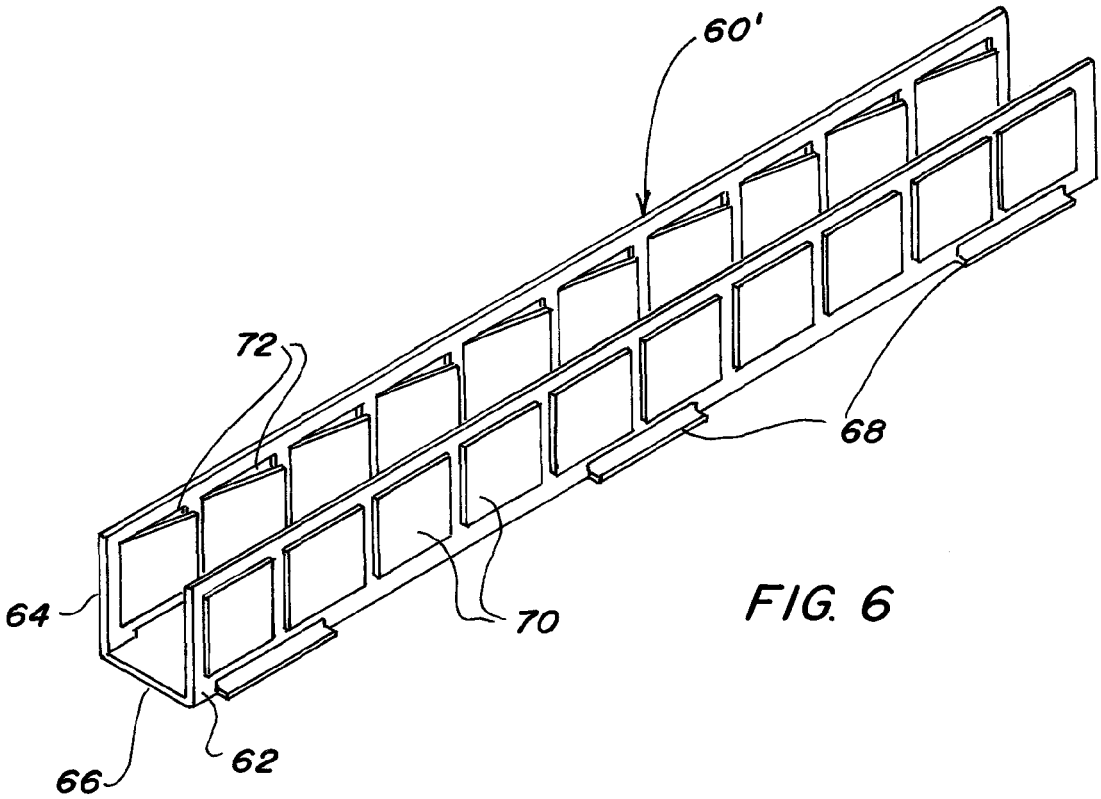

As best seen in FIGS. 5 and 6, slide 60, 60' has front and rear elongated walls 62, 64, respectively, attached to a bottom wall 66. A plurality of tabs 68 may be provided along bottom wall 66 for non-binding receipt on the slideway provided by toes 58 of sleeve 42. A plurality of reflectors 70, of alternating color such as red 70R and green 70G (FIGS. 2A-2C) to indicate different track conditions, are provided on front and rear walls 62, 64 such that railroad switch indicator 10 is reversible. Thus the alternating red reflectors 70R and green reflectors 70G on front wall 62 are in substantial alignment with alternating red reflectors 70R and green reflectors 70G on rear wall 64. Reflectors 70 include reflecting surfaces for reflecting the rays from the headlight of an approaching train, so as to give the operator an indication of the condition of the track or the switch. As shown in FIG. 6, reflectors may be formed on hinged flaps 72 such that the angle of the reflectors may be optimally positioned on both front and rear walls 62, 64 with respect to the curvature of the track on either side of switch 12. Reflectors 70 are spaced such that one set of reflectors is visible through windows 52 when left switchpoint 24 is in contact with left stockrail 14 (FIG. 2B) and the other set of reflectors is visible when right switchpoint 26 is in contact with right stockrail 16 (FIG. 2A).

Referring again to FIG. 5, railroad switch indicator 10 includes a second bracket 74 which is adapted to be attached to transverse bar 28 connected to switchpoints 24, 26. A longitudinally extending arm 76 with an upwardly extending finger 78 is mounted on bracket 74. As shown in FIG. 5, bracket 74 may include upper and lower plates 80 sandwiching a pair of intermediate plates 82 between which a free end of arm 76 may be frictionally engaged when bracket 74 is assembled with suitable fasteners 56. It will be understood that this arrangement permits finger 78 to be moved towards and away from first bracket 32.

Figure 4:
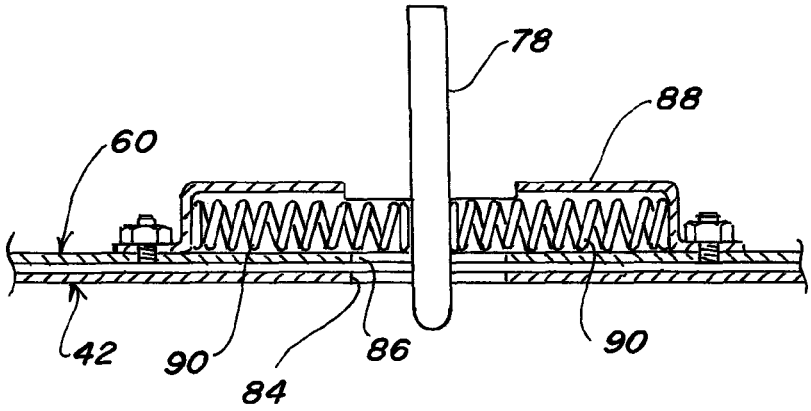
FIG. 4 is a section on an enlarged scale taken along the plane of 4-4 in FIG. 3.

Continuing to FIG. 3 with FIGS. 4-5, by adjustment of arm 76 in second bracket 74, it is seen that finger 78 may be made to pass through a slot 84 provided in first bracket 32 and into an aperture 86 provided in slide 60 for reciprocation of the slide within sleeve 42 conjointly with movement of transverse bar 28 with switchpoints 24, 26. As shown in FIGS. 4 and 5, a housing 88 with a pair of springs 90 may be provided on the inside of slide 60 for biased engagement of finger 78 such that aperture 86 may be larger than finger 78 to compensate for any arced movement of transverse bar 28.

In use, it is seen that railroad switch indicator 10 operates independently of the mechanism for operating switch 30 and functions as an alignment indicator in addition to showing whether switch 12 has been run through. Because railroad switch indicator 10 is mechanically linked to switchpoints 24, 26, operation of the indicator does not depend on electricity. This is an advantage because while it can be used on an electrically powered switch, there are many more mechanically operated switches in the United States than electrically powered switches.

As shown in FIGS. 2A through 2C, railroad switch indicator 10 lined red (FIG. 2A) signals that a train passing through the switch will be directed on a first track, whereas lined green (FIG. 2B) a train will be directed on a second track. Railroad switch indicator 10 lined with a mixture of red and green reflectors (FIG. 2C) indicates danger (i.e., switchpoints 24, 26 are in a mid position).

In view of the above, it will be seen that the several objects of the invention are achieved and other advantageous results attained. As various changes could be made in the above constructions without departing from the scope of the invention, it is intended that all matter contained in the above description or shown in the accompanying drawings shall be interpreted as illustrative and not in a limiting sense.

What is claimed:

1. A railroad switch indicator for use with a switch for switching a railroad train including a pair of stockrails and a pair of switchrails, said switchrails having first ends secured to a track bed and second ends terminating with switchpoints, said switchpoints connected by a transverse bar for conjoint lateral movement of the switchpoints between switching and nonswitching positions, said railroad switch indicator comprising a first bracket adapted to be attached to the track bed between the pair of switchpoints, said bracket supporting a sleeve between and transverse to the stockrails, said sleeve having front and rear walls, said front and rear walls having a plurality of regularly formed spaced apart windows, a slide having front and rear walls received in the sleeve, said front and rear walls having a plurality of reflectors, alternate ones forming first and second sets in different colors to indicate safety conditions of the track, the reflectors being visible through the windows of the sleeve, a second bracket adapted to be attached to the transverse bar connected to the switchpoints, said bracket supporting a longitudinally extending arm with an upwardly extending finger which engages the slide for reciprocation of the slide within the sleeve conjointly with movement of the switchpoints by the transverse bar whereby the first set of reflectors are visible through the windows of the sleeve when the switchpoints are in switching position, the second set of reflectors are visible through the windows of the sleeve when the switchpoints are in nonswitching position and portions of the first and second set of reflectors are visible when the switchpoints are in a mid position indicating a dangerous condition.

2. The railroad switch indicator of claim 1 wherein the sleeve is rectangular with a top wall, an open bottom and front and rear walls with inwardly directed toes forming a slideway for the slide.

3. The railroad switch indicator of claim 1 wherein the slide has a bottom wall, front and rear walls and an aperture for engagement of the finger.

4. The railroad switch indicator of claim 3 wherein a housing with a pair of springs for biased engagement of the finger is provided over the aperture in the bottom wall of the slide.

5. The railroad switch indicator of claim 1 wherein the reflectors have a reflective surface for reflecting the ray from the headlight of an approaching train.

6. The railroad switch indicator of claim 5 wherein the first set of reflectors are red and the second set of reflectors are green.

7. A railroad switch indicator for use with a switch for switching a railroad train including a pair of stockrails and a pair of switchrails, said switchrails having first ends secured to a track bed and second ends terminating with switchpoints, said switchpoints connected by a transverse bar for conjoint lateral movement of the switchpoints between switching and nonswitching positions, said railroad switch indicator comprising a first bracket adapted to be attached to the track bed between the pair of switchpoints, said bracket supporting an elongated, rectangular sleeve between and transverse to the stockrails, said sleeve having a top wall, an open bottom and front and rear walls, said front and rear walls having a plurality of regularly formed spaced apart windows, a rectangular slide having a bottom wall and front and rear walls received in the sleeve, said front and rear walls having a plurality of reflectors mounted on flaps for adjusting the angle of the reflectors, alternate ones of said reflectors forming first and second sets in different colors to indicate safety conditions of the track, the reflectors being visible through the windows of the sleeve, a second bracket adapted to be attached to the transverse bar connected to the switchpoints, said bracket supporting a longitudinally extending arm with an upwardly extending finger which engages the slide for reciprocation of the slide within the sleeve conjointly with movement of the switchpoints by the transverse bar whereby the first set of reflectors are visible through the windows of the sleeve when the switchpoints are in switching position, the second set of reflectors are visible through the windows of the sleeve when the switchpoints are in nonswitching position and portions of the first and second set of reflectors are visible when the switchpoints are in a mid position indicating a dangerous condition.

8. The railroad switch indicator of claim 7 wherein the front and rear walls of the sleeve have inwardly directed toes forming a slideway for the slide and the slide has a plurality of tabs along bottom wall for receipt on the slideway.

9. The railroad switch indicator of claim 7 wherein the first bracket includes a plate with an apron for attachment to flanged sections of a metal cross tie.

10. The railroad switch indicator of claim 9 wherein the plate includes a slot through which the finger passes.

11. The railroad switch indicator of claim 10 wherein the second bracket includes a pair of plates between which the arm is sandwiched for longitudinal adjustment with respect to the second bracket and the slide.

12. The railroad switch indicator of claim 11 wherein the slide has an aperture in the bottom wall for engagement of the finger.

13. The railroad switch indicator of claim 12 wherein a housing with a pair of springs for biased engagement of the finger is provided over the aperture in the bottom wall of the slide.

14. The railroad switch indicator of claim 13 wherein the reflectors have a reflective surface for reflecting the ray from the headlight of an approaching train.

15. The railroad switch indicator of claim 14 wherein the first set of reflectors are red and the second set of reflectors are green.

* * * * *